US005562520A

United States Patent [19]

Pridonoff et al.

[11] Patent Number: 5,562,520

[45] Date of Patent: Oct. 8, 1996

[54] COLLAPSIBLE STRUCTURE

[75] Inventors: Charles L. Pridonoff, Los Angeles; John Stregan, Woodland Hills, both of Calif.

[73] Assignee: Marathon Partners, Los Angeles, Calif.

[21] Appl. No.: 275,140

[22] Filed: Jul. 14, 1994

[51] Int. Cl.[6] ..... A63H 33/38; A63H 3/52

[52] U.S. Cl. ..... 446/148; 446/478; 446/488; 40/539; 40/124.1

[58] Field of Search ..... 446/147, 148, 446/149, 150, 151, 82, 83, 84, 476, 477, 478, 487, 488; 40/539, 124.1

[56] References Cited

U.S. PATENT DOCUMENTS

| | | | |
|---|---|---|---|
| 347,682 | 8/1886 | Buckingham . | |
| 500,848 | 7/1893 | Bruel . | |
| 984,735 | 2/1911 | Bailey | 446/82 |
| 1,586,191 | 5/1926 | Fritzsche . | |
| 1,630,117 | 5/1927 | Faulkner . | |
| 1,742,905 | 1/1930 | Friedel . | |
| 1,867,374 | 7/1932 | Purdy . | |
| 1,891,011 | 12/1932 | Purdy . | |
| 1,959,619 | 5/1934 | Ebert | 40/539 X |
| 2,112,474 | 3/1938 | Warren . | |
| 2,204,264 | 6/1940 | Warren . | |
| 2,232,953 | 2/1941 | Mallgraf . | |
| 2,544,783 | 3/1951 | Freedman et al. | 446/148 X |
| 2,556,323 | 6/1951 | Feigelman . | |
| 2,661,559 | 12/1953 | Klein et al. | 446/147 X |
| 3,343,297 | 9/1967 | Valentine . | |
| 3,629,969 | 12/1971 | Dodd . | |
| 4,435,915 | 3/1984 | Zaruba et al. | 446/488 X |
| 4,759,520 | 7/1988 | Levine | 40/539 X |
| 4,850,060 | 8/1989 | Corbo et al. | 40/539 X |
| 5,317,823 | 6/1994 | Brunt II | 40/539 X |

FOREIGN PATENT DOCUMENTS

| | | | |
|---|---|---|---|
| 0555188 | 8/1993 | European Pat. Off. | 446/487 |
| 156469 | of 0000 | United Kingdom | 40/539 |
| 10656 | of 0000 | United Kingdom | 40/539 |
| 379486 | 9/1932 | United Kingdom | 446/148 |
| 399253 | 10/1933 | United Kingdom | 40/539 |

*Primary Examiner*—Robert A. Hafer
*Assistant Examiner*—D. Neal Muir
*Attorney, Agent, or Firm*—Poms, Smith, Lande & Rose Professional Corporation

[57] ABSTRACT

A collapsible structure which is quickly and easily collapsed to a multi-ply planar structure, then quickly and easily erectable to a self supporting three-dimensional erect structure. The structure, when erected, has a plurality of levels and enclosed areas to provide play and amusement for a child or for other suitable use.

14 Claims, 4 Drawing Sheets

FIG. 1
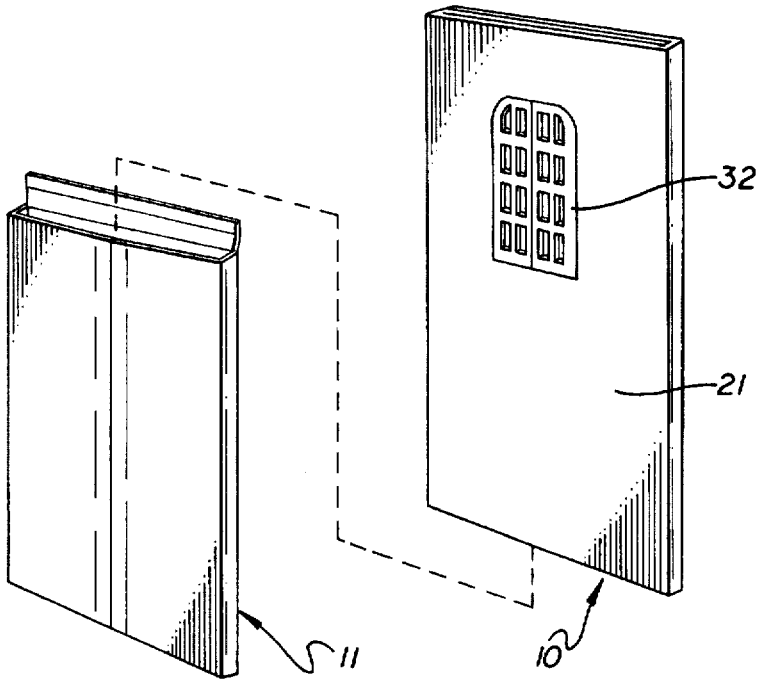
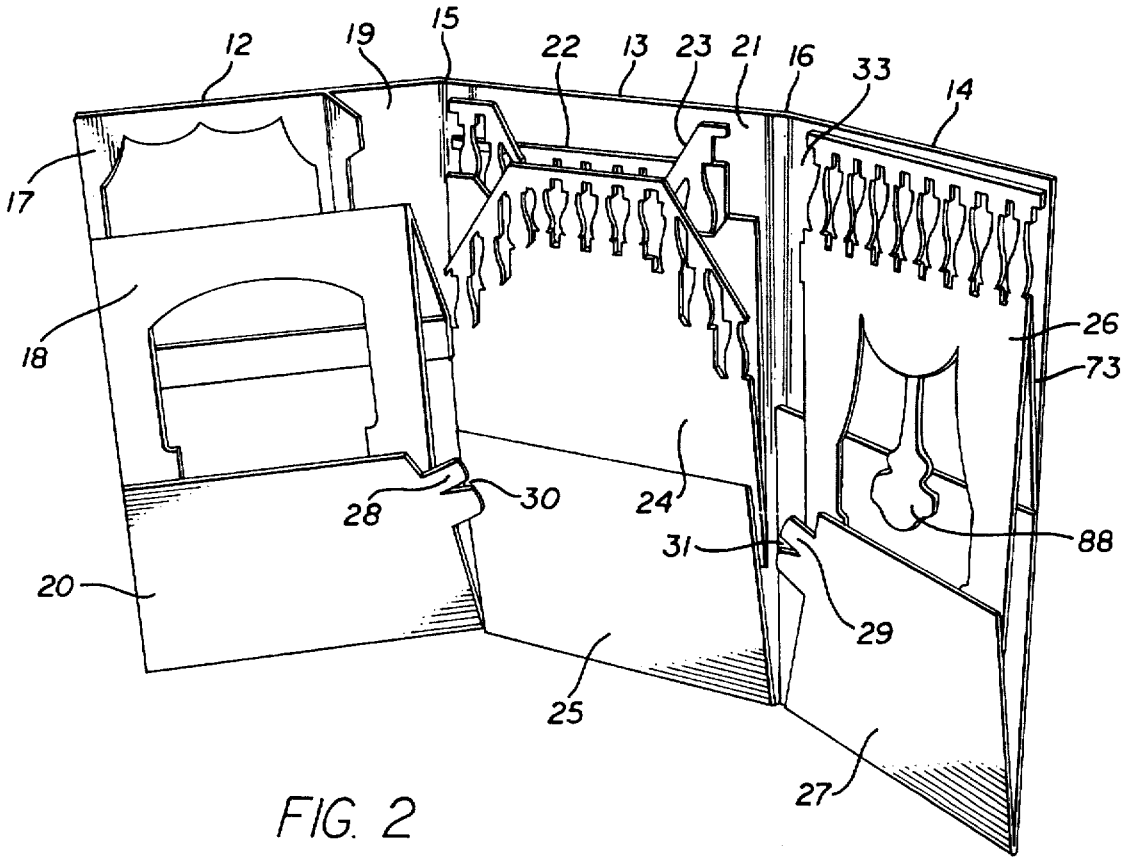
FIG. 2

COLLAPSIBLE STRUCTURE

BACKGROUND OF THE INVENTION

1. Field of the Invention

The invention relates to collapsible structures; and, more particularly, to a self standing three dimensional structure which can be quickly and easily collapsed to a multi-ply planar structure, then quickly and easily re-erected to a three dimensional self standing structure.

2. Description of the Prior Art

Various types of foldable structures are known in the fields of toys and games, advertising, simulated buildings, backdrops, etc. Such structures usually require more than a single operation to move them between a flat folded state to an erected state. Such prior art structures, when erected, whether by a single or multiple operation, may not be of sufficient strength to support pressure on the same, thereby collapsing the same.

This is particularly true where the structure may be used by a child as a house, fort, castle, game board, area encircling a computer, or the like, etc. The child may want to place dolls and furniture or the like in different rooms or openings in the structure putting pressure on the various levels of the structure. Thus, such a structure must be able to withstand repeated use by the child. Also, such structures must be inexpensive, easy to assemble, and able to be stored away when not in use.

There is thus a need for a collapsible structure foldable to a planar configuration, then quickly and easily assembled to a self supporting three dimensional structure capable of sustained play or other use.

SUMMARY OF THE INVENTION

It is an object of this invention to provide a collapsible structure foldable to a flat planar configuration, then easily assemblable to a self-standing three dimensional configuration.

It is a further object of this invention to carry out the foregoing object in essentially a single step with or without quick insertion of mating parts.

It is still another object of this invention to provide a collapsible structure which can be used as a doll house, a fort, a game board, an area encircling a computer, a castle or a tenement by a child or the like.

These and other objects are preferably accomplished by providing a collapsible structure which is quickly and easily collapsed to a multi-ply planar structure, then quickly and easily erectable to a self supporting three-dimensional erect structure. The structure, when erected, has a plurality of levels and enclosed areas to provide play and amusement for a child or for other suitable use. It is of low cost so that one may purchase a specific detailed version thereof.

BRIEF DESCRIPTION OF THE DRAWING

FIG. 1 is an exploded view of the structure in a collapsed position and a carton for carrying or storing the same;

FIG. 2 is a perspective view of the structure of FIG. 1 shown in a first unfolded position;

DESCRIPTION OF THE PREFERRED EMBODIMENT

Figure 3:
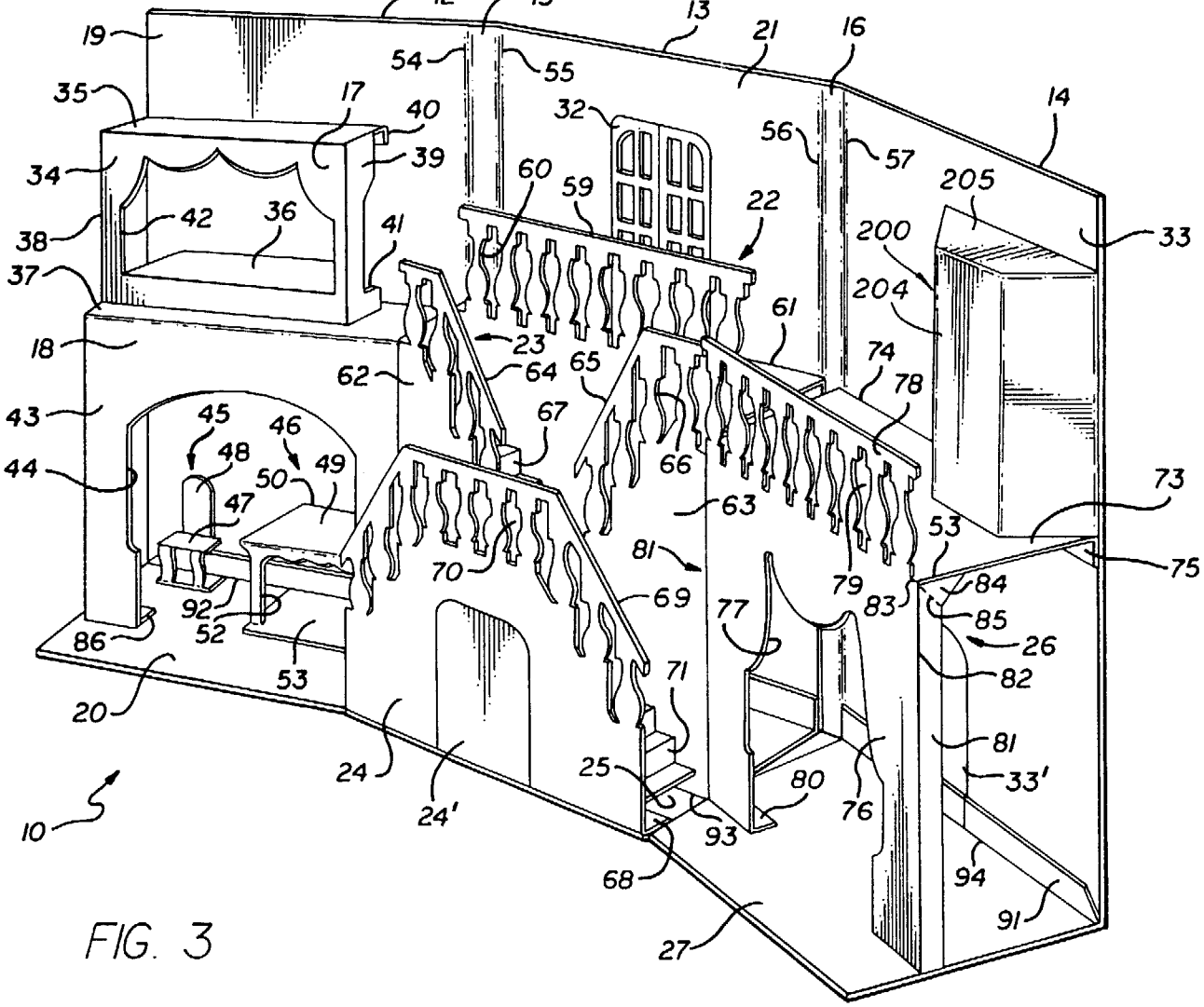
FIG. 3 is a perspective view of the structure alone of FIG. 1 in a fully erected three dimensional self standing position.

Referring now to FIG. 1 of the drawing, a collapsible structure 10 in accordance with the teachings of the invention is shown in a flat planar folded state. As seen, structure 10, in the folded state, can be inserted into a carton or box 11 and quickly and easily stored, shipped, or otherwise transported to another location.

As seen in FIG. 2, structure 10, when initially unfolded, opens into three interconnected sections 12, 13, and 14. Section 12 is interconnected to section 13 along fold panel 15 and section 13 is interconnected to section 14 along fold panel 16 (see FIGS. 3—panels 15, 16 have spaced fold lines 54, 55 panel 15—and 56, 57—panel 16—but may of course be single fold lines). It can be seen that section 12 in FIG. 2 has a plurality, such as two, of folded portions 17, 18 folded up against back panel 19. Lower folded portion 18 has a bottom panel 20 which, as will be seen, will form a base for structure 10. Panel 20 is secured via fold line 92 to rear panel 19. Of course, panels 19, 20 may be of one piece or glued together.

Center section 13 also has a back panel 21 and an upper folded portion 22, a mid folded portion 23, and a lower folded portion 24. Lower folded portion 24 also has a bottom panel 25 which, as will be seen, will form a base for structure 10. Panel 25 is secured, via fold line 93, to rear panel 23. Of course, panels 25 and 21 may be of one piece or glued together.

Section 14 may have a back panel 33 with a single folded portion 26 having a bottom panel 27 which, again as will be seen, will form a base for structure 10. Panel 27 is secured to back wall 33 along fold line 94. Both bottom panels 20, 27 have tabs 28, 29, respectively, extending inwardly toward panel 25. Each tab 28, 29 has a V-shaped notch therein (notches 30, 31, respectively) for reasons to be discussed.

Back panel 21 of section 13 is visible in FIG. 1 and may have a plurality of cutout areas simulating a window 32 or other suitable type of opening for the environment of the structure 10. A door 24' may be provided in lower folded portion 24. A door 33' may be provided through back panel 33.

As previously discussed, unfolding sections 12 to 14 is the first step in assembling structure 10. The entire structure 10 may be made of a suitable planar material, such as cardboard, which, when raised to the position shown in FIG. 2, allows the various folded portions heretofore described to fall by gravity to a position extending outwardly away from their respective back panels 19, 21, and 33. This is the fully assembled position shown in FIG. 3.

As seen in FIG. 3, folded portion 17 is substantially rectangular having a front wall 34, a top wall 35, a bottom wall 36 (spaced from the top wall 37 of lower portion 18) and interconnected side walls 38, 39, respectively. Tab 40, integral with top wall 35 is glued or otherwise secured to back wall 19. Tab 41, integral with bottom wall 36, is also glued or otherwise secured to back wall 19. As seen in FIG. 3, in the fully unfolded position, portion 18 may simulate a room with opening 42 allowing one to view the interior of the room and the furniture therein.

Lower portion 18 has a front wall 43 with inwardly extending tabs 86 (see also FIG. 6) at bottom on each side of opening 44 allowing one to view the interior of the room simulated by portion 18. Tabs 80 are secured to wall 20 as by gluing or the like or any other suitable fastening means, such as by stapling. The interior of portion 18 may have folded-out portions simulating various articles of furniture. Thus, simulated chairs 45 (see also FIG. 4) and a table 46 is shown attached to back wall 19. The seats 47 of chairs 45 fold up on the back 48 when folded to the FIG. 1 position. Table 46 also has a top 49 attached to back wall 19 along fold line 50 so that it folds back on to wall 19 when in the folded FIG. 1 position. The legs 51 of chairs 45 are foldably attached to both seats 47 and panel 20. The legs 52 of table 46 are similarly foldably attached to both table top 49 and a panel 53 secured to panel 20.

The upper portion 22 of mid-section 13 has a bottom panel 58 (see FIG. 5) simulating a floor with an upstanding front panel 59 with cutout areas 60 simulating a railing. Panel 58 is foldably secured to back panel 21 at fold line 61.

Figure 4:
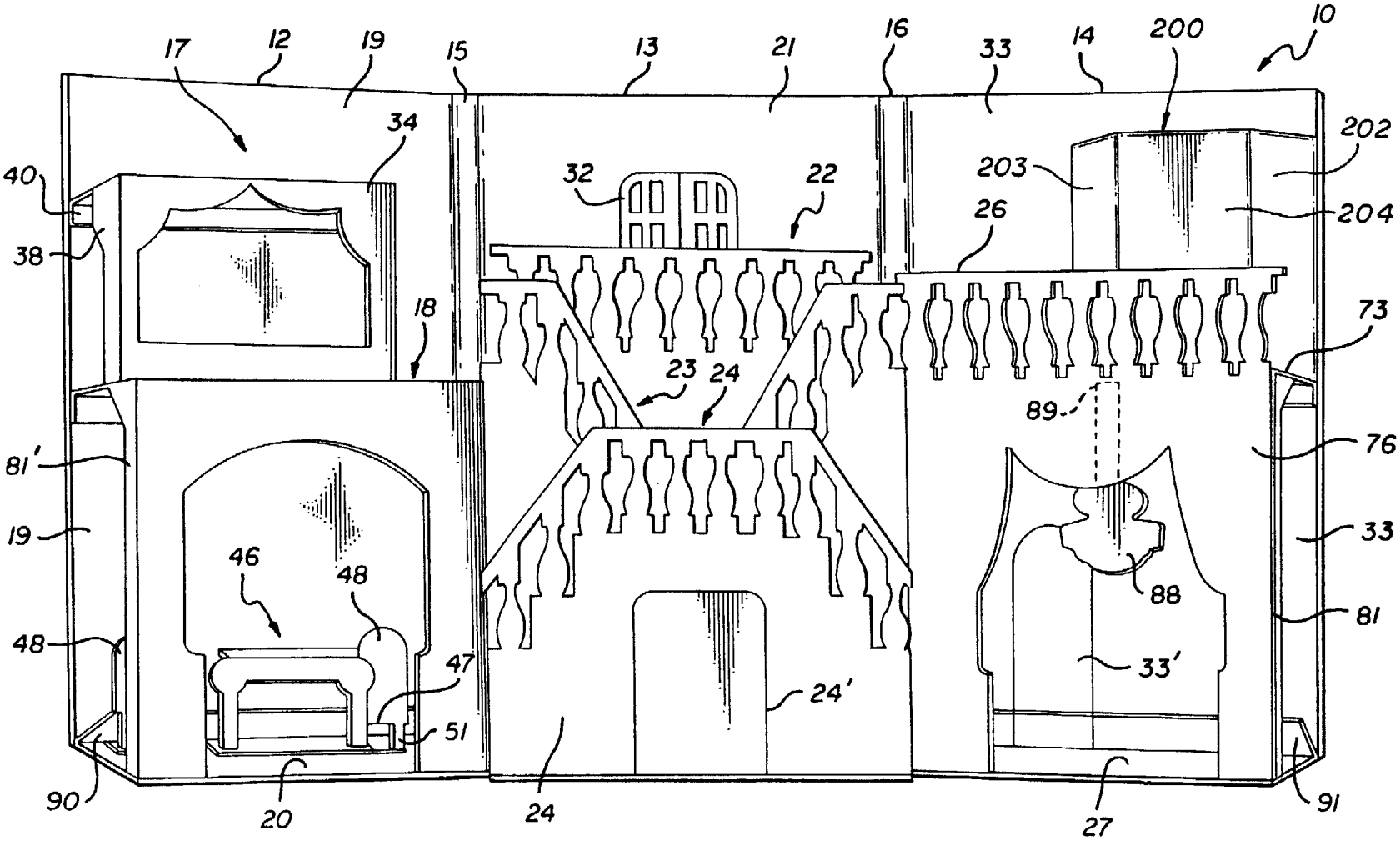
FIG. 4 is a front perspective view of the structure of FIG. 3.

A simulated chandelier 88 (FIGS. 2 and 4) may be provided secured to the underside of wall 73 at fold line 89 as seen in dotted lines in FIG. 4.

Midportion 23 is comprised of two panel sections 62, 63, each section simulating an angled railing 64, 65, respectively, as shown. Thus, each railing 64, 65 has cutout areas 66 similar to areas 60.

Figure 5:
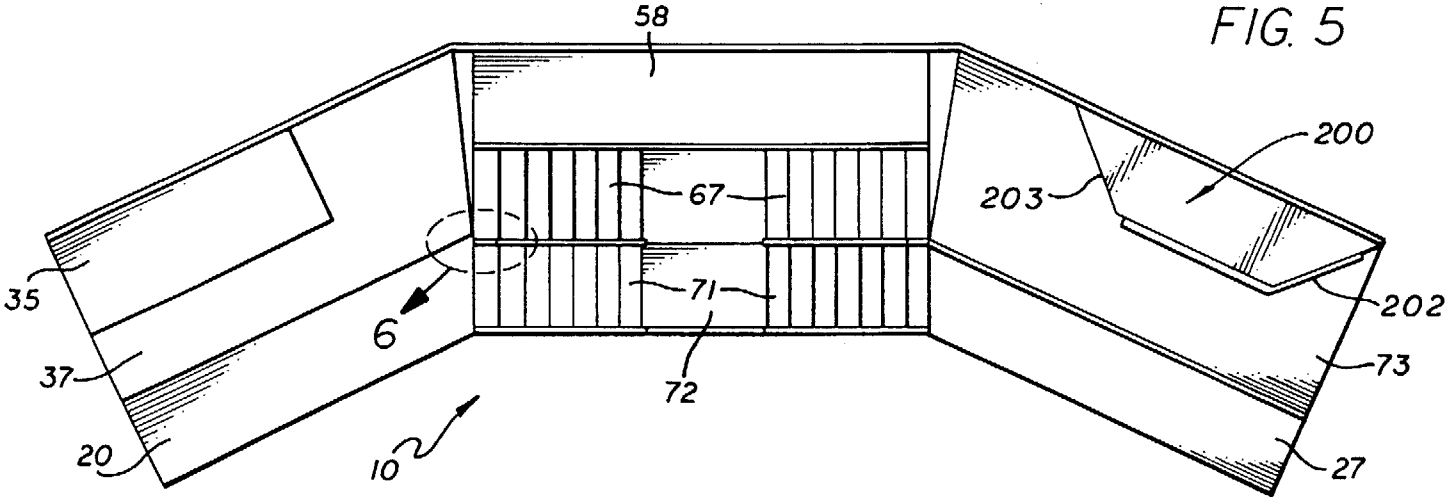
FIG. 5 is a top plan view of the structure of FIG. 3.

Sections 62, 63 are spaced from panel 59 and connected to simulated stairs 67 (see FIG. 5). Lower portion 24 has an inwardly extending tab 68 at bottom secured to bottom panel 25. The upper peripheral edge 69 of panel 24 defines a railing with openings 70 in panel portion 24. As seen in FIGS. 3 and 5, simulated stairs 71 are provided between panel portion 24 and panels 62, 63 of midsection 23. It can be appreciated that stairs 71 go up from panel 25 (see also FIG. 6) to a simulated landing 72 (FIG. 5), then back down as seen in FIG. 3.

Folded portion 26 of section 14 has a top wall 73, secured to back panel 33 along fold line 74. A tab 75 extends downwardly from fold line 74 and is secured, as by gluing, to back wall 33. Folded portion 26 also includes a front wall 76, having opening 77 leading into the interior thereof (thus simulating a room). Front wall 76 has an upper portion 78 extending above top wall 73 with a plurality of cutout areas 79 simulating a railing. Front wall 76, on each side of opening 77, terminates in inwardly extending tabs 80 (only one visible in FIG. 3) secured to bottom wall 27 in any suitable manner, such as by gluing. A vertically extending tab 81 is also provided on each side of front wall 76 (only one visible in FIG. 3) secured wall 27, secured via fold line 82 to front wall 76 and at top via fold line 83 to wall 73. As seen in FIG. 3, tabs 81 each have an angled portion 84 with a fold line 85 to assist in folding of tab 81 (and thus portion 26) when folded to the FIG. 1 position. Thus, tabs 81 fold away when the structure 10 is collapsed yet return to a supporting erect position when structure 10 is erected.

Figure 6:
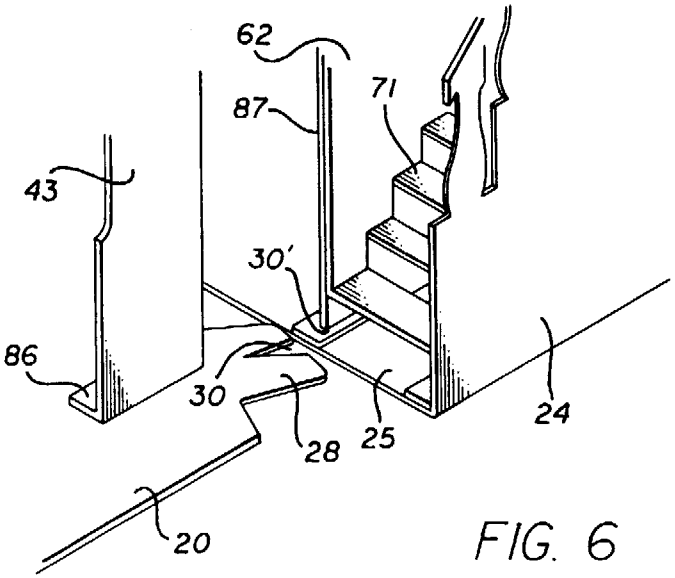
FIG. 6 is a perspective view of the circled portion of FIG. 5.

As seen in FIG. 6, in order to form the fully erected position shown in FIG. 3, the V-shaped notches 30, 31 of tabs 28, 29, respectively, receive therein the side edges 87 of panel sections 62, 63 (only section 62 is shown in FIG. 6). This mating notches provides a friction hold after being guided into position with some stress thereon holding the parts in place.

All of the walls or panels may be secured together in a folded relationship in any suitable manner. These walls and panels may be reinforced where necessary. For example, as seen in FIG. 4, bottom walls 20, 27 may have integral rear flanges 90, 91 secured to their respective back walls or panels 19, 33 in any suitable manner, such as by gluing.

As seen in FIGS. 3 to 5, a wardrobe 200 may be provided on back wall 33. Wardrobe 200 includes a top wall 205 (FIG. 3), outwardly flared side walls 202, 203 (see also FIGS. 4 and 5) and a front wall 204 (FIG. 3).

It can be seen that structure 10 can be unfolded from the FIG. 1 position, to the FIG. 2 position, then, by merely allowing the panel sections to fall by gravity, the structure is essentially in the position shown in FIGS. 3 and 4. The tabs 28, 29 automatically lock in place as heretofore discussed when the structure is erected.

The structure 10, FIG. 3, can then be used as a play house, doll house, castle, game board, area surrounding a computer, etc. A child may place dolls or the like on the various levels and stairs and may place furniture in the rooms. The structure 10, made of a suitable foldable material, such as reinforced cardboard, chipboard, etc. will stand up to repeated use. After such use, tabs 28, 29 are automatically unlocked when structure 10 is placed on its back and the main panels 17, 18, 22, 23, 24, and 76 pushed inwardly resulting in the folded position shown in FIG. 2. The three sections are then folded to the final position shown in FIG. 1.

Although structure 10 simulates the interior of a house, a play scene for dolls or action figures, game board, castle or the like, obviously other structures may be simulated merely by varying the simulated floor levels, rooms, placement of stairs, etc. For example, a tenement, a fort, haunted house, shopping center, etc. may be simulated. Any suitable size may be used.

The play appeal may be increased by using printed designs or decals or the like (or painted accordingly). The foldaway structural tabs 81, 81' assist greatly in the quick folding and unfolding of structure 10 while providing vertical support. The mating notches 30, 31 and 30' provide a friction hold on the erected structure 10 yet quickly and easily lock and unlock. The angular relationship of the sections 12, 13 and 14 also greatly assist in the stability of structure 10 when erected, and its quick folding thereof. The entire structure 10 is a low cost, easy to manufacture, can stand up to repeated usage, then discarded after such use and replaced with another similar structure.

There is thus disclosed an inexpensive structure quickly and easily folded or unfolded providing great play appeal and able to withstand repeated usage. Although a particular embodiment of the invention is disclosed, variations thereof may occur to an artisan and the scope of the invention is only to be limited by the scope of the appended claims.

We claim:

1. A collapsible structure movable from a first flat planar folded position to a fully erect three-dimensional position comprising:

a first planar base panel secured via a fold line to a first planar back wall, said first planar back wall being foldably secured along a vertical edge thereof to a second planar back wall;

a second planar base panel secured via a fold line to said second planar back wall;

a first three-dimensional structure having a first top wall and a first vertical front wall said first vertical front wall hingedly connected to said first planar base panel, said first vertical front wall forming an interior of said three-dimensional structure and also having an opening leading into the interior of said three-dimensional structure, said first top wall being foldably connected to said first back wall, said first top wall being foldably connected to said front wall; and a second three-dimensional structure having a second top wall and a second vertical front wall said second vertical front wall hingedly connected to said second planar base panel, said second vertical front wall forming an interior of said second three-dimensional structure and also having an opening leading into the interior of said second three-dimensional structure, said second top wall being foldably connected to said second front wall whereby said first base panel may be folded up toward said first back wall with said first three-dimensional structure sandwiched therebetween and said second base panel may be folded up toward said second back wall with said second three-dimensional structure sandwiched therebetween, said first folded base panel, said first folded back wall and said first folded three-dimensional structure then capable of being folded toward said second folded base panel, said second folded three-dimensional structure and said second folded back wall to form a generally flat planar multiply folded structure whereby said structure can be in a fully folded flat planar position and moved to a fully erect self supporting three-dimensional position by opening said planar back walls away from each other and folding said base panels downward from said back walls.

2. In the structure of claim 1 including a third planar base panel secured via fold line to a third planar back wall, said third planar back wall being foldably secured along a vertical edge thereof to a vertical edge of said second planar back wall spaced from said first planar back wall; and a third three-dimensional structure having a top wall and a vertical front wall having an opening leading into the interior of said third three-dimensional structure, said last mentioned top wall being foldably connected to said third back wall, said last-mentioned top wall being foldably connected to said last mentioned front wall.

3. In the structure of claim 2 wherein said first base panel has a V-shaped locking tab extending toward said second three-dimensional structure, the second vertical front wall of said second three-dimensional structure having a first vertical edge receivable therein.

4. In the structure of claim 3 wherein said third base panel has a V-Shaped locking tab extending toward said second three-dimensional structure, the second vertical front wall of said second three-dimensional structure having a second vertical edge spaced from said first vertical edge receivable therein in said last mentioned locking tab.

5. In the structure of claim 1 wherein said first base panel has a V-shaped locking tab extending toward said second three-dimensional structure, the second vertical front wall of said second three-dimensional structure having a first vertical edge receivable therein.

6. In the structure of claim i including a third three-dimensional structure mounted to said first back wall, said third three-dimensional structure being disposed above said first three-dimensional structure and having a third top wall foldably connected to said first back wall and a third front wall foldably connected to both said third top wall and the first top wall of said first three-dimensional structure forming an interior of said third three-dimensional structure, said last mentioned front wall having an opening leading into the interior of said third three-dimensional structure.

7. In the structure of claim 1 wherein said first three-dimensional structure has a side wall foldably connected along a vertical edge thereof to a vertical edge of the first front wall of said first three-dimensional structure, said side wall being foldably connected to said first top wall of said first three-dimensional structure and to said first base panel.

8. In the structure of claim 1 including a third three-dimensional structure mounted to said first back wall, said third three-dimensional structure being disposed above said first three-dimensional structure and having a third top wall foldably connected to said first back wall and a third front wall foldably connected to both said third top wall and the first top wall of said first three-dimensional structure forming an interior of said third three-dimensional structure, said third front wall having an opening leading into the interior of said third three-dimensional structure, said third three-dimensional structure having a third side wall foldably connected along a vertical edge of the third front wall of said third three-dimensional structure, said third side wall being foldably connected to said third top wall of said third three-dimensional structure and to said first top wall, said third side wall is foldably connected to said third top wall of said third three-dimensional structure by a triangularly shaped tab having a fold line therein extending from the intersection of said third top wall of said third three-dimensional structure and said third front wall.

9. In the structure of claim 1 including a third three-dimensional structure mounted to said second back wall above said second three-dimensional structure, said third three-dimensional structure having a top wall foldably connected to said second back wall and a vertical front wall foldably connected to both said top wall of said third three-dimensional structure and to said second three-dimensional structure.

10. In the structure of claim 9 including a fourth three-dimensional structure mounted to said second back wall below said second three-dimensional structure, said fourth three-dimensional structure having a top wall foldably connected to both said second three-dimensional structure and to said second base panel.

11. In the structure of claim 1 including at least one simulated three dimensional element mounted internally of said first three dimensional structure having a first portion foldably secured to said first back wall and a second portion integral with said first portion foldably secured to said first base panel.

12. In the structure of claim 1 wherein said top wall of said second three-dimensional structure has a plurality of horizontal portions vertically spaced from each other simulating stairs.

13. In the structure of claim 1 wherein said front wall of said second three-dimensional structure extends above the top wall thereof simulating a railing.

14. In the structure of claim 13 wherein said simulated railing has a plurality of spaced cutout areas therein.

* * * * *